US009038244B2

(12) United States Patent
Tonelli et al.

(10) Patent No.: US 9,038,244 B2
(45) Date of Patent: May 26, 2015

(54) HINGE FOR TRANSPORT CASES, TRUNKS, SUITCASES AND THE LIKE

(75) Inventors: Massimo Tonelli, Casalecchio di Reno (IT); Alessio Concettoni, Ancona (IT)

(73) Assignee: G.T. LINE-S.R.L., Crespellano (IT)

( * ) Notice: Subject to any disclaimer, the term of this patent is extended or adjusted under 35 U.S.C. 154(b) by 0 days.

(21) Appl. No.: 13/261,167

(22) PCT Filed: Aug. 4, 2009

(86) PCT No.: PCT/IT2009/000361

§ 371 (c)(1),
(2), (4) Date: Feb. 1, 2012

(87) PCT Pub. No.: WO2011/016062

PCT Pub. Date: Feb. 10, 2011

(65) Prior Publication Data

US 2012/0131765 A1 May 31, 2012

(51) Int. Cl.

| | |
|---|---|
| ***A45C 13/00*** | (2006.01) |
| ***A45C 13/36*** | (2006.01) |
| ***E05D 5/06*** | (2006.01) |
| ***E05D 9/00*** | (2006.01) |

(52) U.S. Cl.

CPC ..... *A45C 13/005* (2013.01); *Y10T 156/10* (2015.01); *Y10T 29/4984* (2015.01); *Y10T 16/558* (2015.01); *E05D 5/06* (2013.01); *Y10T 16/55963* (2015.01); *Y10T 16/554* (2015.01); *Y10T 16/5595* (2015.01); *Y10S 16/13* (2013.01); *E05D 9/005* (2013.01); *A45C 13/36* (2013.01)

(58) Field of Classification Search

CPC ..... E05D 5/02; E05D 5/0215; E05D 5/0223; E05D 5/023; E05D 5/0238; E05D 5/06; E05D 7/10; E05D 7/12; E05D 2007/128; A45C 13/36; A45C 13/005

USPC ..... 16/387, 388, 389, 390, 391, 392; 220/848, 844, 843, 836, 845

See application file for complete search history.

(56) References Cited

U.S. PATENT DOCUMENTS

| | | | | | |
|---|---|---|---|---|---|
| 1,092,236 | A | * | 4/1914 | Wrkieman | 16/271 |
| 1,529,646 | A | * | 3/1925 | Aldeen | 16/374 |
| 1,847,757 | A | * | 3/1932 | Gasstrom | 33/496 |
| 2,243,065 | A | | 5/1941 | Barrett | |
| 2,758,332 | A | | 8/1956 | Augensen, Jr. | |
| 4,546,874 | A | * | 10/1985 | Kirchhan | 220/4.22 |
| 5,370,254 | A | * | 12/1994 | Hardigg et al. | 220/4.22 |
| 5,398,379 | A | * | 3/1995 | Kiefer | 16/364 |

(Continued)

FOREIGN PATENT DOCUMENTS

| | | | | | |
|---|---|---|---|---|---|
| DE | 10 2004 025389 | A1 | | 12/2005 | |
| GB | 2099070 | A | * | 12/1982 | E05D 3/02 |
| GB | 2225808 | A | * | 6/1990 | E05D 5/02 |

*Primary Examiner* — Jeffrey O Brien

(74) *Attorney, Agent, or Firm* — Modiano & Associati; Daniel J. O'Byrne; Albert Josif

(57) ABSTRACT

A hinge for transport cases, trunks, suitcases and the like, comprising two elements which are mutually articulated about a common axis and are both able to rotate with respect to the common axis. Each element is delimited by two parallel walls and has a total width that is equal to the width of the channel delimited between the stiffening ribs of the transport case, suitcase or trunk on which it will be installed. Each element is associable with the stiffening ribs of the respective transport case, once it is inserted between the ribs, without requiring any mechanical machining of the surfaces of the case.

9 Claims, 5 Drawing Sheets

(56) References Cited

U.S. PATENT DOCUMENTS

| | | | | |
|---|---|---|---|---|
| 5,788,874 | A * | 8/1998 | Tucker, Jr. | 249/180 |
| 5,791,018 | A * | 8/1998 | Yoshinobu | 16/374 |
| 5,884,363 | A * | 3/1999 | Tofts | 16/223 |
| 5,906,029 | A * | 5/1999 | Fox | 16/386 |
| 6,058,566 | A * | 5/2000 | Kerr et al. | 16/387 |
| 6,619,723 | B2 * | 9/2003 | Duffy | 296/146.11 |
| 6,698,492 | B2 * | 3/2004 | Lewis, Jr. | 160/201 |
| 6,701,577 | B1 * | 3/2004 | Yeh | 16/376 |
| 7,827,655 | B2 * | 11/2010 | Yi | 16/261 |
| 2004/0231106 | A1 * | 11/2004 | Shire | 16/390 |

* cited by examiner

HINGE FOR TRANSPORT CASES, TRUNKS, SUITCASES AND THE LIKE

The present invention relates to a hinge for transport cases, trunks, suitcases and the like, particularly suitable for application on trunks, suitcases and other containers suitable for transporting various items, made of rigid material.

BACKGROUND OF THE INVENTION

The transport of material, especially for delicate and/or expensive items, requires the use of containers that are adapted to preserve all their characteristics, protecting them against any impacts and abrasions that might occur during the various steps of the transport.

The storage of goods and their loading and unloading in fact submit such goods to impacts (against other items and crates) and frictions which might damage them (both in functional terms and more simply from an aesthetic point of view).

One thus resorts to dedicated containers in order to preserve all the characteristics of certain products during transport.

For example, photo and video recording material is accommodated within adapted technical cases, which have compartments (generally lined with shock-absorbing expanding material) for each component and which have a particularly tough and solid external shell.

Likewise, weapons also are carried by means of similar containers: in this case, the mechanical strength of the shells that constitute the case can be used effectively in order to ensure that no one can open such case. If the closure of the shells is ensured by means of adapted locks and/or padlocks, it is impossible to access the weapons, also because the shells are strong enough to render ineffective many break-in actions aimed at penetrating/breaking them.

The shape and dimensions of these cases and trunks are such as to make it possible to keep the products inside them in constant conditions (when they are not in use). For this reason, it is convenient for these containers to be substantially bistable, being able to maintain, without presenting problems of any type, both the closed configuration and the open configuration for an unspecified amount of time.

However, with known types of containers it is not possible to keep the contained products in a position that is good from the display viewpoint: the person who views the products must place himself above the trunk rested on the ground in order to view its contents.

In order to provide particularly tough containers, one also resorts to the construction of separate shells, in practice a bottom and a lid, which must be juxtaposed upon closure and subsequently locked in this mated configuration.

This solution is particularly advantageous from a production point of view, since the components to be mated do not need to have elements for mutual articulation in order to allow opening by hinging along one edge.

On the other hand, the absence of hinges makes their use more complicated.

It is not possible to convert containers in which the bottom and lid are not associated into containers in which they are mutually hinged without compromising their characteristics.

Fixing a hinge to the bottom and to the lid in fact entails providing holes therein for the stable coupling of such hinge: the provision of holes makes it impossible to preserve all the characteristics that were initially present in the container.

Some containers in fact have a hermetic seal, an extremely high mechanical strength, and are adapted to work in corrosive environments, and these characteristics would be certainly compromised if a hinge were fitted through holes provided in the two shells (bottom and lid).

SUMMARY OF THE INVENTION

The aim of the present invention is to solve the drawbacks described above, by proposing a hinge for transport cases, trunks, suitcases and the like that makes it possible to arrange the suitcase, the trunk and in general the container on which it is installed stably in the open configuration and in the closed configuration, maintaining a position that is convenient for the display of the contained products to the people who are present.

Within this aim, an object of the invention is to propose a hinge for transport cases, trunks, suitcases and the like that can be applied also to suitcases, trunks and containers that lack hinges between the bottom and the lid without compromising any characteristic thereof, both in terms of mechanical strength and in terms of tightness, even hermetic tightness, and suitability to work in aggressive environments.

Another object of the invention is to propose a hinge for transport cases, trunks, suitcases and the like that is particularly tough and solid and therefore suitable even for challenging installations.

Another object of the present invention is to provide a hinge for transport cases, trunks, suitcases and the like that has low costs, is relatively simple to provide in practice and safe in application.

This aim and these objects, as well as others that will become better apparent hereinafter, are achieved by a hinge for transport cases, trunks, suitcases and the like, of the type that comprises two elements which are mutually articulated about a common axis and which are both able to rotate with respect to said common axis, characterized in that each element is delimited by two parallel walls and has a total width that is equal to the width of the channel delimited between the stiffening ribs of the transport case, suitcase, trunk on which it will be installed, each element being associable with the stiffening ribs of the respective transport case, once it is inserted between said ribs, without requiring any mechanical machining of said surfaces of the case.

BRIEF DESCRIPTION OF THE DRAWINGS

Further characteristics and advantages of the invention will become better apparent from the detailed description that follows of a preferred but not exclusive embodiment of the hinge for transport cases, trunks, suitcases and the like, according to the invention, illustrated by way of non-limiting example in the accompanying drawings, wherein.

DESCRIPTION OF THE PREFERRED EMBODIMENTS

Figure 1:
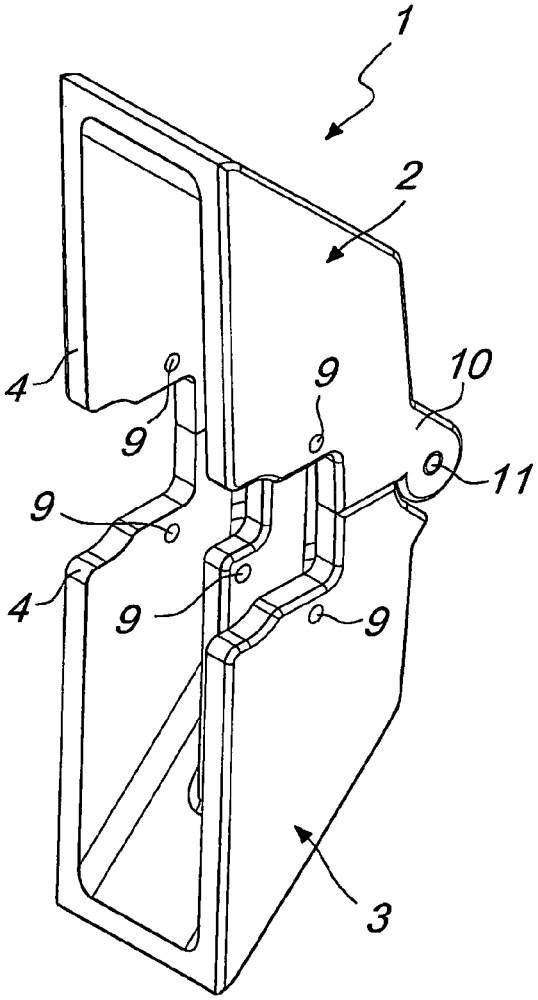
FIG. 1 is a perspective view of a hinge according to the invention.
Figure 2:
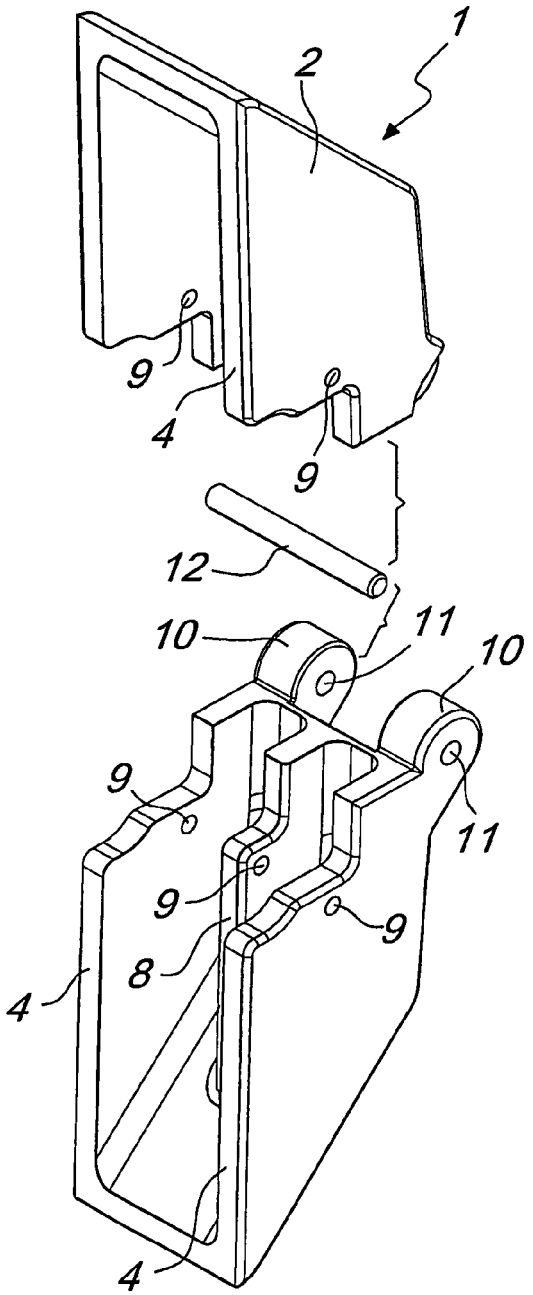
FIG. 2 is an exploded perspective view of the hinge according to the invention.
Figure 3:
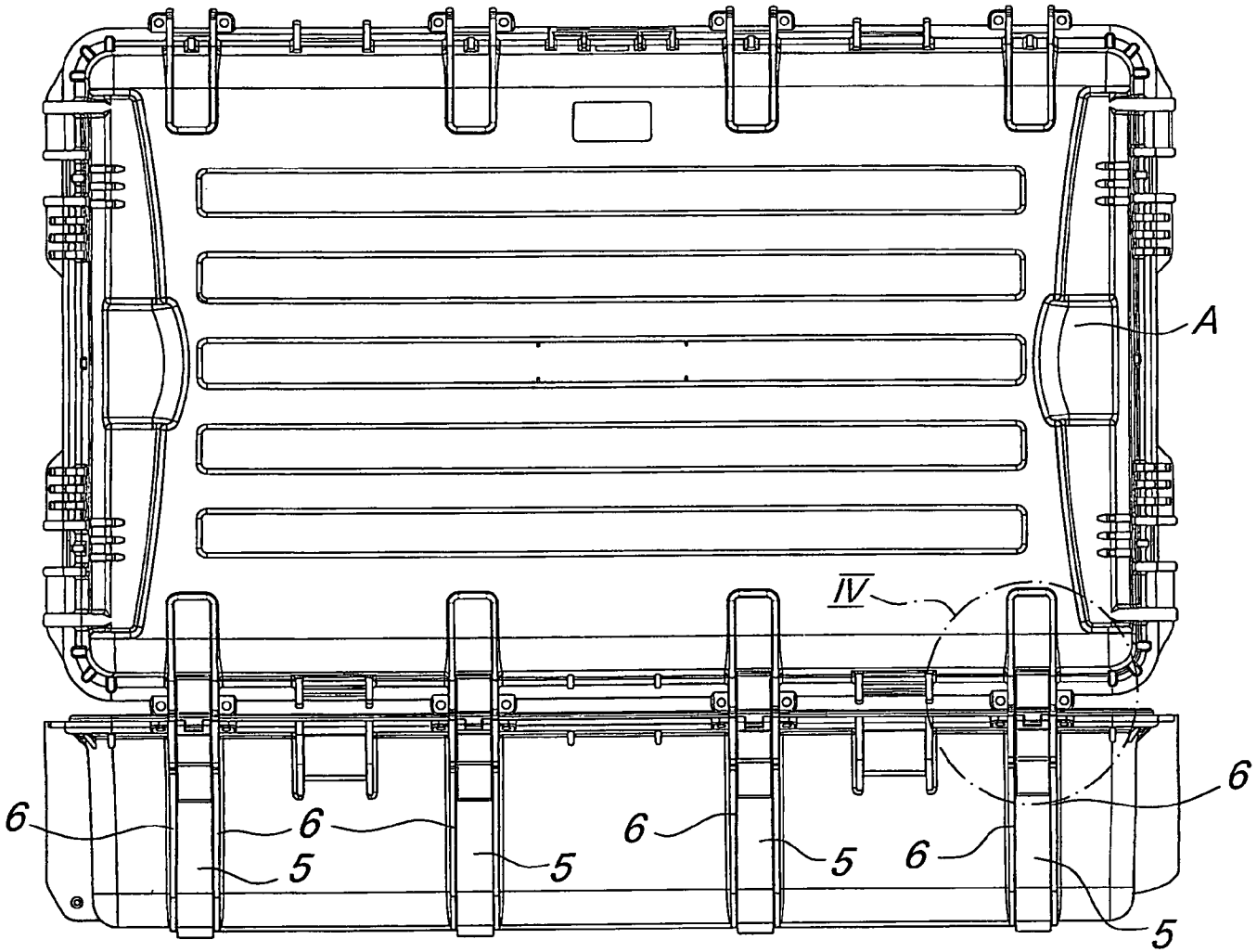
FIG. 3 is a perspective view of a case provided with hinges according to the invention.
Figure 4:
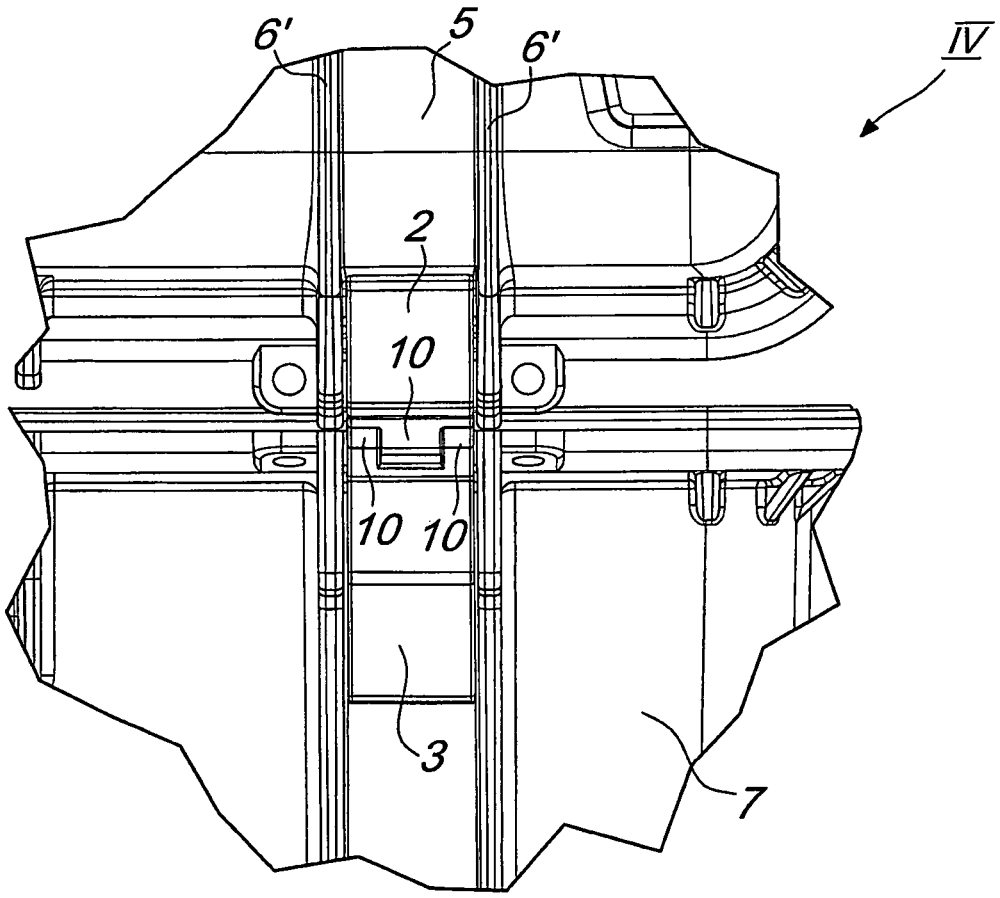
FIG. 4 is an enlarged-scale perspective view of the detail IV of FIG. 3.
Figure 5:
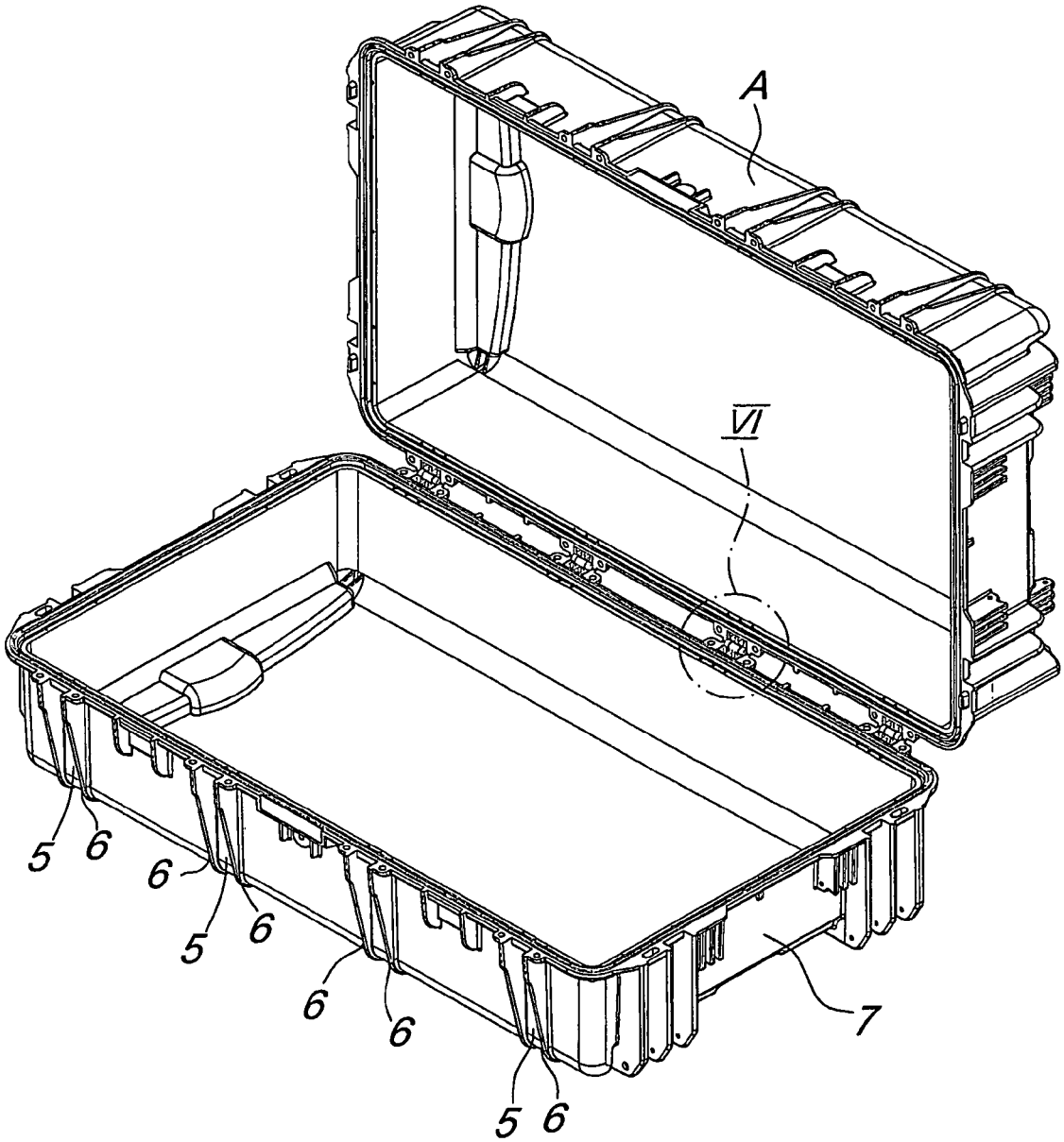
FIG. 5 is a perspective view of a case provided with hinges according to the invention.
Figure 6:
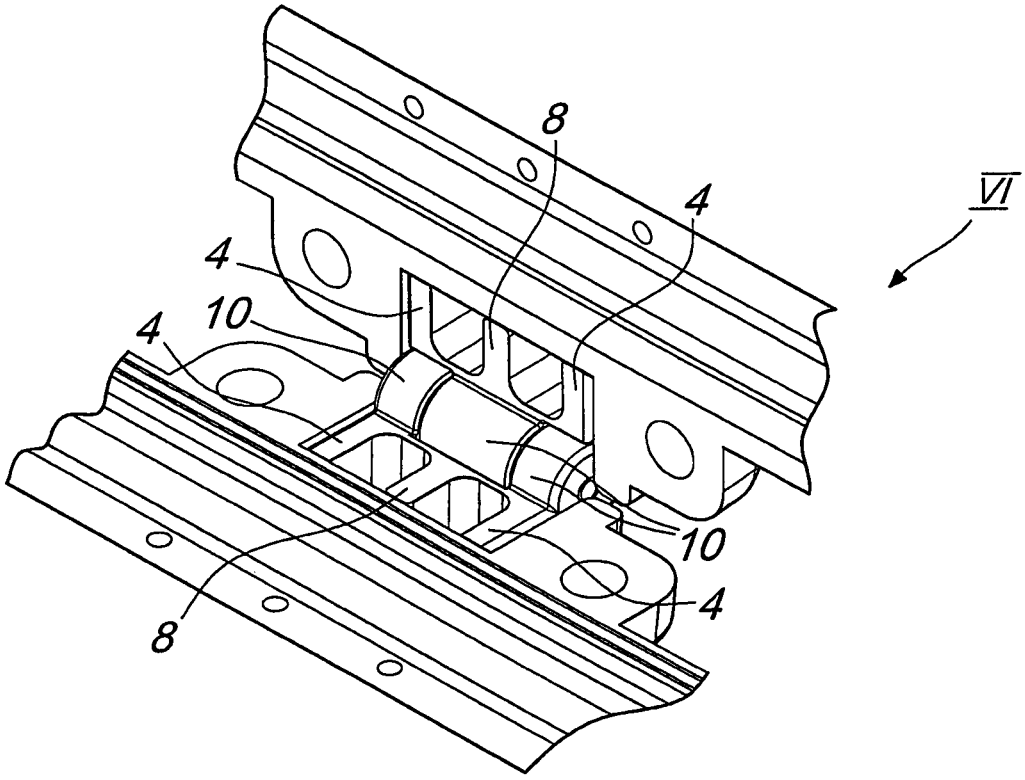
FIG. 6 is an enlarged-scale perspective view of the detail VI of FIG. 5.

With reference to the figures, the reference numeral 1 generally designates a hinge for transport cases A, trunks, suitcases and the like.

The hinge 1 comprises two elements 2 and 3, which are mutually articulated about a common axis and which are both able to rotate with respect to said axis.

Each element 2 or 3 is delimited by two parallel walls 4 and has a total width that is equal to the width of a channel 5 delimited by stiffening ribs 6 of the transport case A, suitcase or trunk, on which it will be installed.

Each element 2 or 3 therefore can be coupled to the stiffening ribs 6 of the respective transport case A, once it has been inserted between them, without requiring any mechanical machining of the surfaces 7 of the transport case A.

According to an embodiment of particular interest in practice and in application, at least one ridge 8 for increasing the mechanical strength of the element 2 or 3 is interposed between the parallel walls 4. The presence of the ridge 8 in fact makes each element 2 or 3 adapted to withstand intense mechanical loads, since it increases its flexural and torsional rigidity.

Each individual element 2 or 3 has, according to an embodiment that is simple and certain to provide, at least one through hole 9 in the walls 4 and in the at least one ridge 8 if said ridge is present in order to increase rigidity.

The hole 9 is designed to fix the element 2 or 3 to the stiffening ribs 6 of the respective transport case A, suitcase or trunk. Once the element 2 or 3 has been inserted between the ribs 6, it is sufficient to insert in the channel 5 a pin, a screw, a nail or other equivalent connecting element within respective fixing seats provided on the ribs 6 (optionally also provided at the fitting time in order to achieve fixing) in alignment with the holes 9 in order to ensure stable mating.

Advantageously, this mating does not produce any mechanical machining on the surfaces 7 of the transport case A and therefore its performance is not compromised in any way with the fitting of the hinge 1. In particular, said fitting does not cause any variation of performance in terms of hermetic tightness, resistance to corrosive environments and mechanical strength, since it entails no modification or operation on the surfaces 7.

Analyzing more specifically each individual hinge 1, it can be seen that each element 2 or 3 comprises at least one substantially cylindrical portion 10 provided with a transverse channel 11.

In the configuration for fitting the hinge 1 on the transport case A, the cylindrical portions 10 of two elements 2 and 3 are aligned and the respective transverse channels 11 lie on a same axis: the channels 11 are designed to accommodate a respective articulation pivot 12.

It should be specified that the at least one cylindrical portion 10 is preferably arranged on the side opposite to the one that can be inserted between the stiffening ribs 6 of the transport case A.

From the point of view of the fitting of a single hinge 1, it should be noted that a cylindrical portion 10 is associated with one end of a respective first element 2 of the hinge 1 and its dimensions and shape are complementary to those of the cylindrical portion 10 of the second element 3 of the hinge 1.

When fitting of the hinge 1 according to the invention on the transport case, trunk or suitcase has been completed perfectly, the walls 4 rest with their outer faces on the inner faces of the stiffening ribs 5 of the transport case A, suitcase or trunk, with the optional interposition of adhesive substances.

The presence of adhesive substances, although optional, may be convenient for making the connection of the parts particularly tough and stable or for providing a protective layer that completely covers the shank, nail or screw that is inserted within the holes 9 (if the transport case A is used in a corrosive environment, the protective layer would protect said connecting element from the aggressive action of said environment).

From a purely geometric point of view, it can be noted that in the embodiment shown in the accompanying figures (which is understood not to be limiting for the inventive concept of the present invention) each element 2 or 3 has substantially the profile of a right-angled trapezoid, its longer base being designed to rest on the surface 7 of the transport case A, suitcase or trunk, its shorter base being directed outward, the side that is perpendicular to the bases being surmounted by the at least one cylindrical portion 10 and the inclined side being arranged opposite the articulation area.

Advantageously, the hinge 1 according to the invention allows, once it has been correctly fitted onto the respective transport case A, suitcase or trunk, when the transport case A is open, the shorter bases of the mated elements 2 and 3 to be arranged so as to face each other and be proximate, optionally even in contact, constituting a stroke limit for the opening motion.

This makes it possible to arrange the transport case A "vertically", with one perimetric edge rested on the ground and with the hinges 1 arranged on the rear of the transport case A with respect to an observer.

In this manner, by means of the hinges 1, the case is converted into a display, simplifying the identification of the contained products for the assigned personnel, since interested parties can see them conveniently without having to bend down.

The method for fixing the hinge 1 according to the invention to a transport case A (fixing which can be performed both at the factory, on the semifinished components, and on cases A that are already in use in order to increase their performance and versatility) consists of a sequence of steps.

In a first step a) it is necessary to arrange a first element 2 of the hinge 1 between the stiffening ribs 4 of the lid of the transport case A, suitcase or trunk.

In a subsequent step b), the first element 2 has to be fixed to the stiffening ribs 4 of the lid.

A third step c) consists in arranging a second element 3 of the hinge 1 between the stiffening ribs 4 of the bottom of the transport case A, suitcase or trunk, and a fourth step d) consists in fixing the second element 3 to the respective ribs 4.

A fifth step e) entails juxtaposing the first element 2 and the second element 3, aligning the respective cylindrical portions 10 so that their transverse channels 11 lie on the same axis. It is thus possible to perform a final step f), which provides for the insertion of the pivot 12 along the channels 11 in order to provide the mutual articulation of the two elements 2 and 3.

Fixing of the elements 2 and 3 to the lid and to the bottom of the transport case A, suitcase or trunk is achieved by inserting transverse stems (generically connecting elements, nails, screws, etcetera) within through holes of the walls 4 of each element 2 or 3 and in the ribs 6 of the transport case A, suitcase or trunk.

Each element 2 or 3 is thus locked on the stiffening ribs 6 of the respective transport case A, suitcase or trunk.

Likewise, the fixing of the elements 2 and 3 to the lid and to the bottom of the case A, suitcase or trunk can be obtained with the interposition of adhesive substances between the walls 4 of each element 2 or 3 and the ribs 6 of the transport case A, suitcase or trunk.

In this case also, the element 2 or 3 is therefore locked onto the stiffening ribs 6 of the respective transport case A, suitcase or trunk.

The invention thus conceived is susceptible of numerous modifications and variations, all of which are within the scope of the appended claims; all the details may further be replaced with other technically equivalent elements.

In the exemplary embodiments shown, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

In practice, the materials used, as well as the dimensions, may be any according to requirements and to the state of the art.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

What is claimed is:

1. A hinge installed on a transport case that comprises a lid and a bottom, said lid and said bottom each having a respective surface provided with stiffening ribs that are arranged so as to delimit therebetween a channel, the hinge comprising a first hinge element and a second hinge element, which are mutually articulated about a common axis and are both able to rotate with respect to said common axis, wherein each said first and second hinge elements is shaped so as to be delimited by two parallel walls and to have a total width that is equal to a width of the channel delimited between the stiffening ribs of the transport case, and wherein said first hinge element is inserted in a first said channel formed between the stiffening ribs of the lid, and said second hinge element is inserted in a second said channel formed between the stiffening ribs of the bottom of the transport case, said second channel being in a position corresponding to a position of said first channel so that said first and second hinge elements are both able to rotate with respect to said common axis, said first hinge element being fixed to the stiffening ribs of the first channel by means of a single first fixing stem engaged in through holes provided in said two parallel walls of said first hinge element and through fixing seats provided on the stiffening ribs of the first channel in alignment with said through holes of said two parallel walls of the first hinge element, and said second hinge element being fixed to the stiffening ribs of the second channel by means of a single second fixing stem engaged in through holes provided in said two parallel walls of said second hinge element and through fixing seats provided on the stiffening ribs of the second channel in alignment with said through holes of said two parallel walls of the second hinge element, without any mechanical machining being performed on said surface of the lid and bottom of the transport case.

2. The hinge according to claim 1, wherein at least one of said first and second hinge elements comprises at least one ridge for increasing the mechanical strength thereof, said at least one ridge being provided interposed between said two parallel walls of the first and second hinge elements.

3. The hinge according to claim 2, further comprising a through hole provided in said at least one ridge, said through hole accommodating a respective said fixing stem for fixing said first and second hinge elements, respectively, to the stiffening ribs that form said first and second channels.

4. The hinge according to claim 1, wherein each said first and second hinge element comprises at least one substantially cylindrical portion provided with a respective transverse channel, the cylindrical portions of said first and second hinge elements being aligned and the respective transverse channels being arranged on said same common axis and accommodating a respective articulation pivot.

5. The hinge according to claim 4, wherein said at least one cylindrical portion is arranged on a side of said first and second hinge element that lies opposite a side thereof inserted in said first and second channels between the stiffening ribs of said lid and bottom of the transport case.

6. The hinge according to claim 4, wherein said at least one cylindrical portion is associated with one end of said first hinge element and dimensions and shape thereof are complementary to those of the at least one cylindrical portion of the second hinge element.

7. The hinge according to claim 1, wherein said two parallel walls of said first and second hinge elements rest with outer faces thereof bearing against inner faces of the stiffening ribs of said first and second channels, adhesive substances being interposable between said outer and inner faces.

8. The hinge according to claim 4, wherein each one of said two parallel walls of said first and second hinge element is shaped as a right-angled trapezoid, wherein a longer base thereof rests on the surface of the lid or bottom of the transport case, a shorter base thereof is directed outward, a side that is perpendicular to the bases is surmounted by the at least one cylindrical portion and an inclined side is arranged opposite the common axis.

9. The hinge according to claim 8, wherein the lid and the bottom in opened configuration, the shorter bases of said two parallel walls of said first and second hinge elements face each other and are mutually proximate, in mutual contact, constituting a stroke limit for an opening motion of the lid and bottom.

* * * * *